US007617707B2

(12) United States Patent
Chiang

(10) Patent No.: US 7,617,707 B2
(45) Date of Patent: Nov. 17, 2009

(54) WINDOW-LOCKING ASSEMBLY

(76) Inventor: Fanny Chiang, 11Fl. -4, No. 16, Chungming S. Rd., West Dist., Taichung (TW)

( * ) Notice: Subject to any disclaimer, the term of this patent is extended or adjusted under 35 U.S.C. 154(b) by 356 days.

(21) Appl. No.: 11/536,692

(22) Filed: Sep. 29, 2006

(65) Prior Publication Data

US 2008/0078214 A1 Apr. 3, 2008

(51) Int. Cl.
*E05B 65/00* (2006.01)

(52) U.S. Cl. ..... 70/89; 49/394; 292/336.3; 70/90; 70/210

(58) Field of Classification Search ..... 70/89, 70/90, 210, 215–217; 292/336.3, DIG. 20, 292/DIG. 47; 49/394, 395
See application file for complete search history.

(56) References Cited

U.S. PATENT DOCUMENTS

| | | | | | |
|---|---|---|---|---|---|
| 2,648,967 | A * | 8/1953 | Holmsten | 70/89 |
| 2,755,654 | A * | 7/1956 | Valentine | 70/89 |
| 3,270,536 | A * | 9/1966 | Sprung | 70/89 |
| 3,468,142 | A * | 9/1969 | Sprung | 70/89 |
| 3,593,547 | A * | 7/1971 | Taylor | 70/89 |
| 4,803,808 | A * | 2/1989 | Greisner | 49/394 |
| 5,318,333 | A * | 6/1994 | Dreifert | 292/336.3 |
| 5,730,477 | A * | 3/1998 | Nagy | 292/32 |
| 5,741,031 | A * | 4/1998 | Bauman et al. | 292/139 |
| 5,829,802 | A * | 11/1998 | Anderson et al. | 292/336.3 |
| 5,839,767 | A * | 11/1998 | Piltingsrud | 292/336.3 |
| 5,927,768 | A * | 7/1999 | Dallmann et al. | 292/158 |
| 6,109,668 | A * | 8/2000 | Demarco | 292/161 |
| 6,135,511 | A * | 10/2000 | Smith et al. | 292/156 |
| 6,349,576 | B2 * | 2/2002 | Subliskey | 70/90 |
| 6,367,853 | B1 * | 4/2002 | Briggs | 292/336.3 |
| 6,519,984 | B1 * | 2/2003 | Morris | 70/210 |
| 6,651,389 | B2 * | 11/2003 | Minter et al. | 49/394 |
| 6,923,029 | B2 * | 8/2005 | Waschgler | 70/210 |
| 2008/0066382 | A1 * | 3/2008 | Erickson | 49/246 |

* cited by examiner

*Primary Examiner*—Suzanne D Barrett
(74) *Attorney, Agent, or Firm*—Apex Juris, pllc; Tracy M Heims

(57) ABSTRACT

A window-locking assembly is used on a window assembly and has a body, a drive device and a locking device. The body has a chamber, two detents, a pivot hole, a spring seat and two latch grooves. The drive device is attached pivotally to the body and has a handle, a mounting head and a jacket. The mounting head protrudes from the handle, is mounted rotatably in the pivot hole and extends into the chamber. The locking device is connected to the drive device in the chamber and has a locking arm, a resilient element and a mounting element. The locking arm is attached pivotally to the mounting head with the mounting element. The resilient element is mounted on the spring seat and presses against the locking arm.

14 Claims, 15 Drawing Sheets

WINDOW-LOCKING ASSEMBLY

BACKGROUND OF THE INVENTION

1. Field of the Invention

The present invention relates to a locking assembly, and more particularly relates to a window-locking assembly used on one of the sides of a window at individual time to lock a window quickly and conveniently.

2. Description of Related Art

In general, a window is mounted in a window frame, and a conventional window-locking assembly is mounted on the window frame to lock the window to the window frame to prevent unauthorized access to a room. However, children can open the conventional lock assembly easily and often forget lock the window when they close the window.

Therefore, the invention provides a window-locking assembly to mitigate or obviate the aforementioned problems.

SUMMARY OF THE INVENTION

The main objective of the present invention is to provide a window-locking assembly that can mount on one of the sides of a window at individual time and close the window quickly and conveniently.

A window-locking assembly in accordance with the present invention is used on a window assembly and has a body, a drive device and a locking device. The body has a chamber, two detents, a pivot hole, a spring seat and two latch grooves. The drive device is attached pivotally to the body and has a handle, a mounting head and a jacket. The mounting head is formed on and protrudes from the handle, is mounted rotatably in the pivot hole and extends into the chamber. The jacket is mounted longitudinally on the handle. The locking device is connected to the drive device in the chamber and has a locking arm, a resilient element and a mounting element. The locking arm is attached pivotally to the mounting head. The resilient element is mounted on the spring seat and presses against the locking arm. The mounting element is mounted around the mounting head opposite to the pivot hole in the body.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
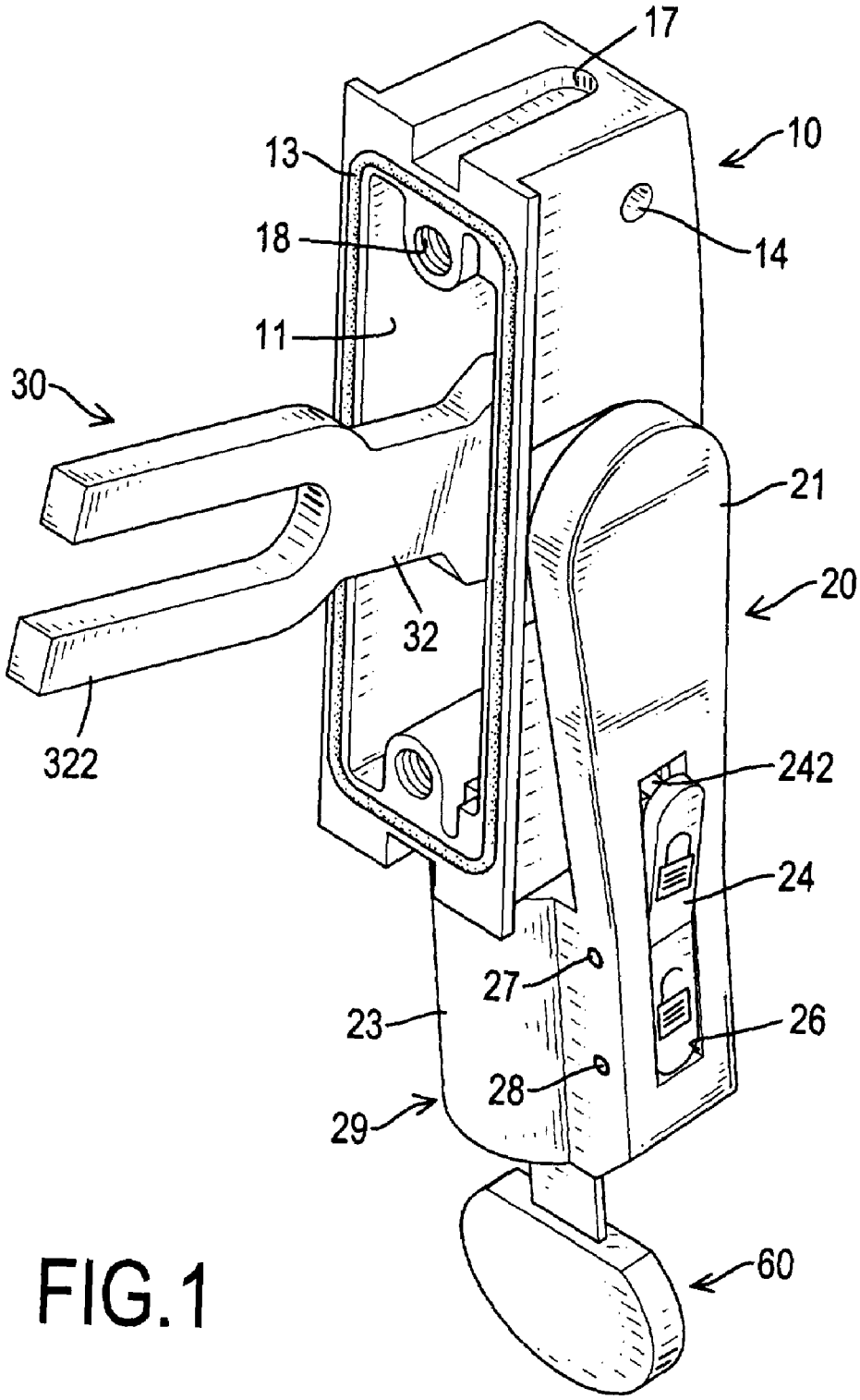
FIG. 1 is a perspective view of a window-locking assembly in accordance with the present invention.

With reference to FIGS. 1, 2, 3 and 4, a window-locking assembly in accordance with the present invention is used on a window assembly (50) having two sides, a frame (54) and a window (53), mounted on one of the sides to selectively lock the window (53) in the frame (54) and comprises a body (10), a drive device (20) and a locking device (30).

The frame (54) of the window assembly (50) is hollow, is mounted through a wall and has an inside surface, a locking edge, a pivot edge and a locking slide. The locking slide is mounted movably in the locking edge of the frame (54) and has multiple locking posts (51). The locking posts (51) are formed through and protrude perpendicular from the locking slide.

Figure 5:
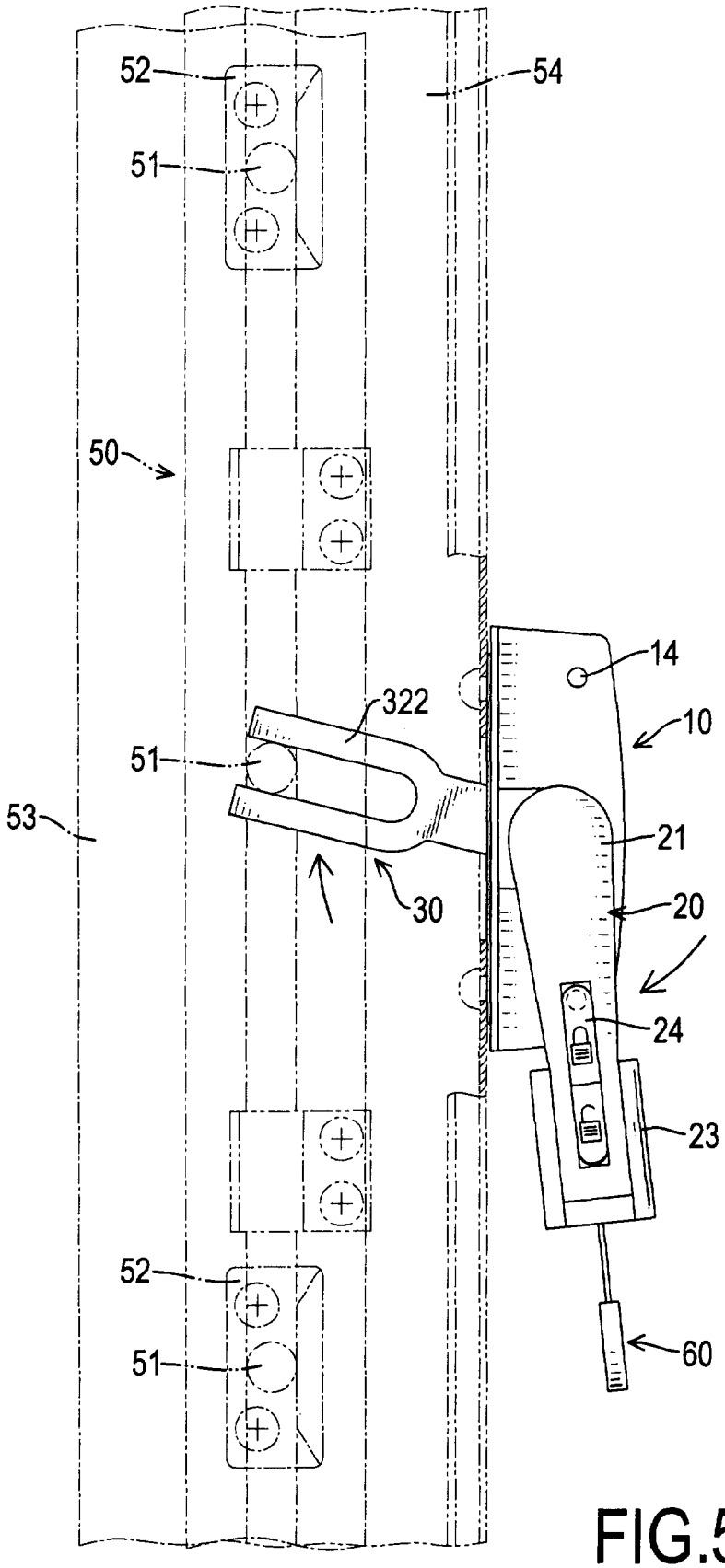
FIG. 5 is another operational side view of the window-locking assembly that in FIG. 1 with the window locked in the frame.

The window (53) is attached pivotally to the frame (54) and has a pivot edge, a locking edge and multiple locking blocks (52). The pivot edge of the window (53) is attached pivotally to the pivot edge of the frame (54). The locking blocks (52) are mounted on the locking edge of the window (53) and correspond respectively to the locking posts (51) on the locking slide on the frame (54), and each locking block (52) has a locking protrusion. The locking protrusion of the locking block (52) is trapezoidal, is formed on and protrudes out from the locking block (52) away from the window (53), is selectively blocked by a corresponding locking post (51) on the locking slide on the frame (54) to hold the window (53) closed in the frame (54) and has a long inner side and a short outer side. With further reference to FIG. 5, the short outer sides are blocked respectively by the locking posts (51) when the window (53) is locked in the frame (54).

The body (10) is attached to the inside surface of the frame (54) on the locking edge and has an open front, a closed rear, a sidewall, an optional top, an optional bottom, a chamber (11), an optional seal groove (12), an optional waterproof seal (13), two optional detents (14), a pivot hole (15), an optional spring seat (16), two optional latch grooves (17), two optional mounting holes (18) and two optional fasteners.

The chamber (11) is defined in the body (10) between the open front and the closed rear.

The seal groove (12) is formed in the open front of the body (10) around the chamber (11).

The waterproof seal (13) is mounted in the seal groove (12) to prevent water from flowing into the chamber (11) through the open front.

The detents (14) are formed through a sidewall of the body (10) respectively near the top and bottom of the body (10) and communicate with the chamber (11).

The pivot hole (15) is formed through the sidewall between the top and bottom of the body (10) and communicates with the chamber (11).

The spring seat (16) is formed in the chamber (11) adjacent to the sidewall with the pivot hole (15), communicates with the pivot hole (15) and has an upper shoulder, a lower shoulder and a central recess.

The latch grooves (17) are formed respectively in the top and the bottom of the body (10).

The mounting holes (18) are formed in the open front of the body (10) respectively near the top and the bottom, may be formed completely through the body (10) and may have an internal thread.

The fasteners connect the body (10) to the frame (54), extend through the frame (54), are secured respectively in the mounting holes (18) and may be two bolts. The bolts screw respectively into the internal threads in the mounting holes (18).

The drive device (20) is mounted pivotally in the body (10) and has a handle (21), a mounting head (22), an optional buckling device (29), an optional washer (25), an optional latch recess (26), an optional rocking latch (24), an optional pivot pin (27) and an optional holding pin (28).

The handle (21) has a distal end, a proximal end, an inner surface, an outer surface and two side edges.

The mounting head (22) is formed on and protrudes from the inner surface of the handle (21) near the proximal end, is mounted rotatably in the pivot hole (15), extends into the chamber (11) in the body (10) and has a central shaft (221) and an outer bearing surface and driver (222). The central shaft (221) has a distal end, a proximal end and an optional annular groove. The proximal end is attached to the inner surface of the handle (21). The annular groove is formed around the central shaft (221) near the distal end. The outer bearing surface and driver (222) is formed part way around the central shaft (221) at the proximal end, protrudes radially out from the central shaft (221) and inscribes an angle.

The washer (25) is mounted around the mounting head (22) and engages with the pivot hole (15) in the body (10).

The buckling device (29) is formed on and protrudes from the inner surface of the handle (21) near the distal end and has an optional jacket (23) and an optional fastening element.

The jacket (23) is a hollow cylinder, is mounted longitudinally on the inner surface of the handle (21) near the distal end and has a closed inner end, an open outer end and a through hole (231). The closed inner end of the jacket (23) selectively aligns with the latch grooves (17) in the top and the bottom of the body (10). The through hole (231) in the jacket (23) is formed coaxially through the closed inner end and selectively communicates with the latch grooves (17) at the top or the bottom of the body (10) and the open outer end of the jacket (23).

Figure 2:
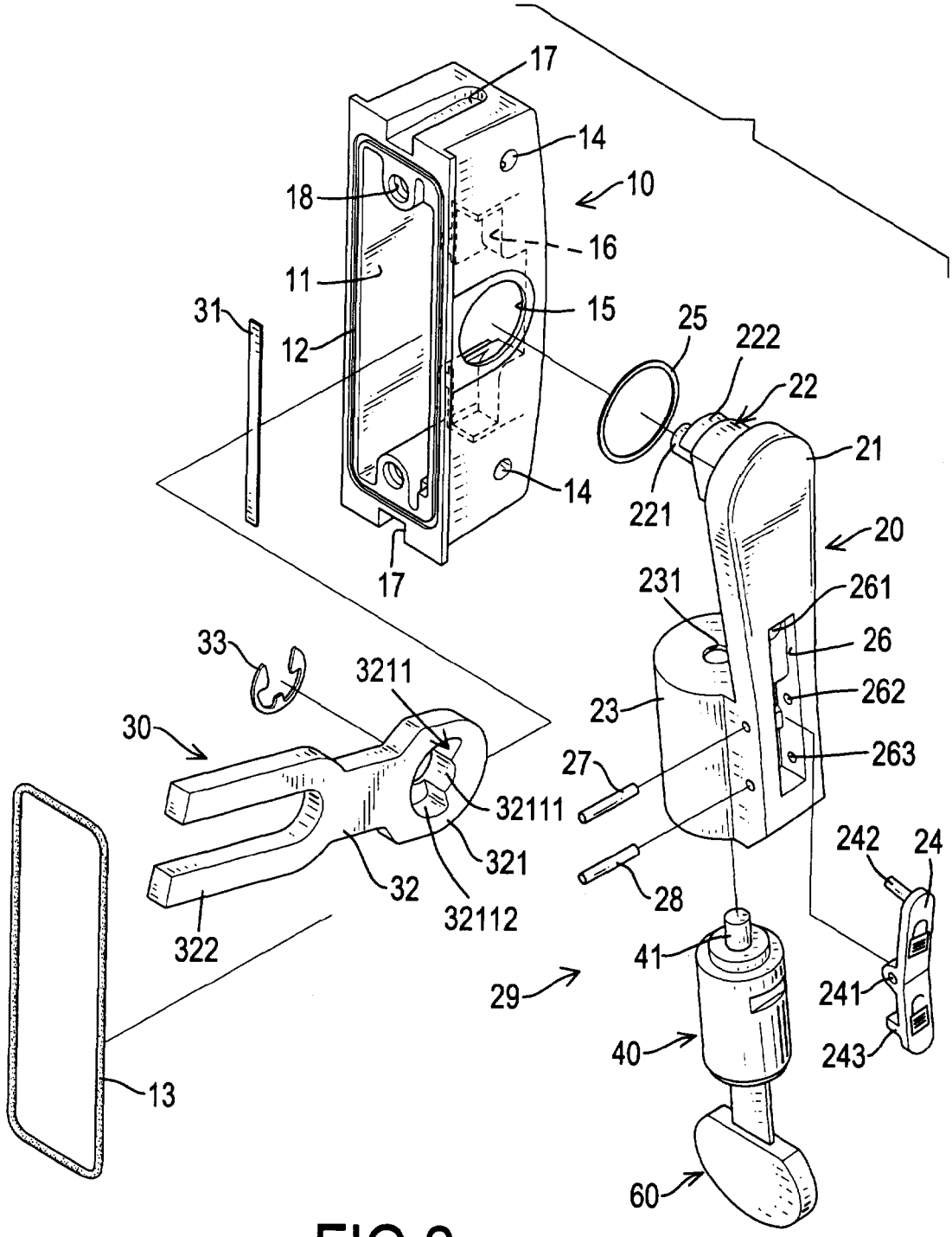
FIG. 2 is an exploded perspective view of the window-locking assembly in FIG. 1.
Figure 3:
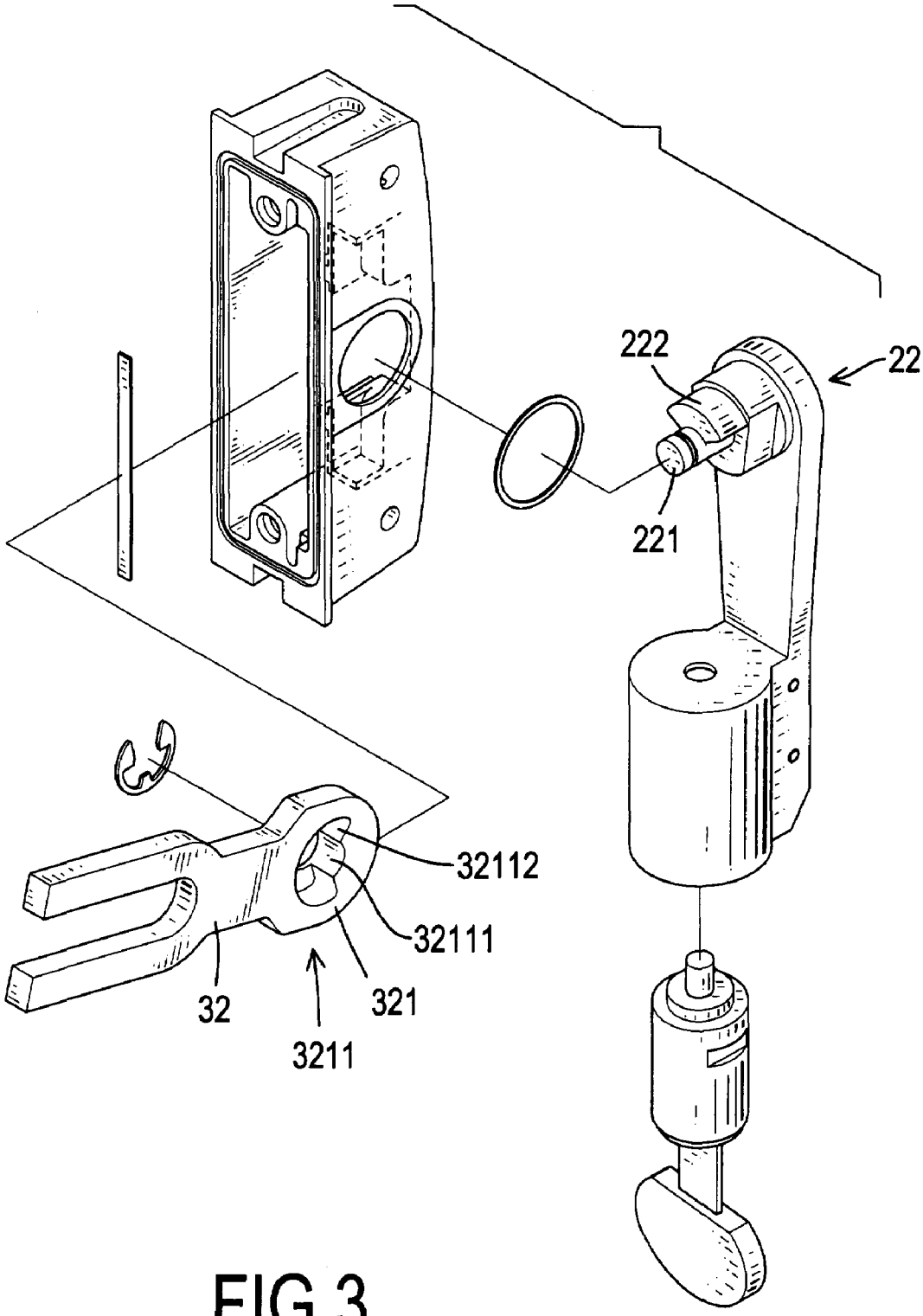
FIG. 3 is another exploded perspective view of the window-locking assembly in FIG. 1.
Figure 4:
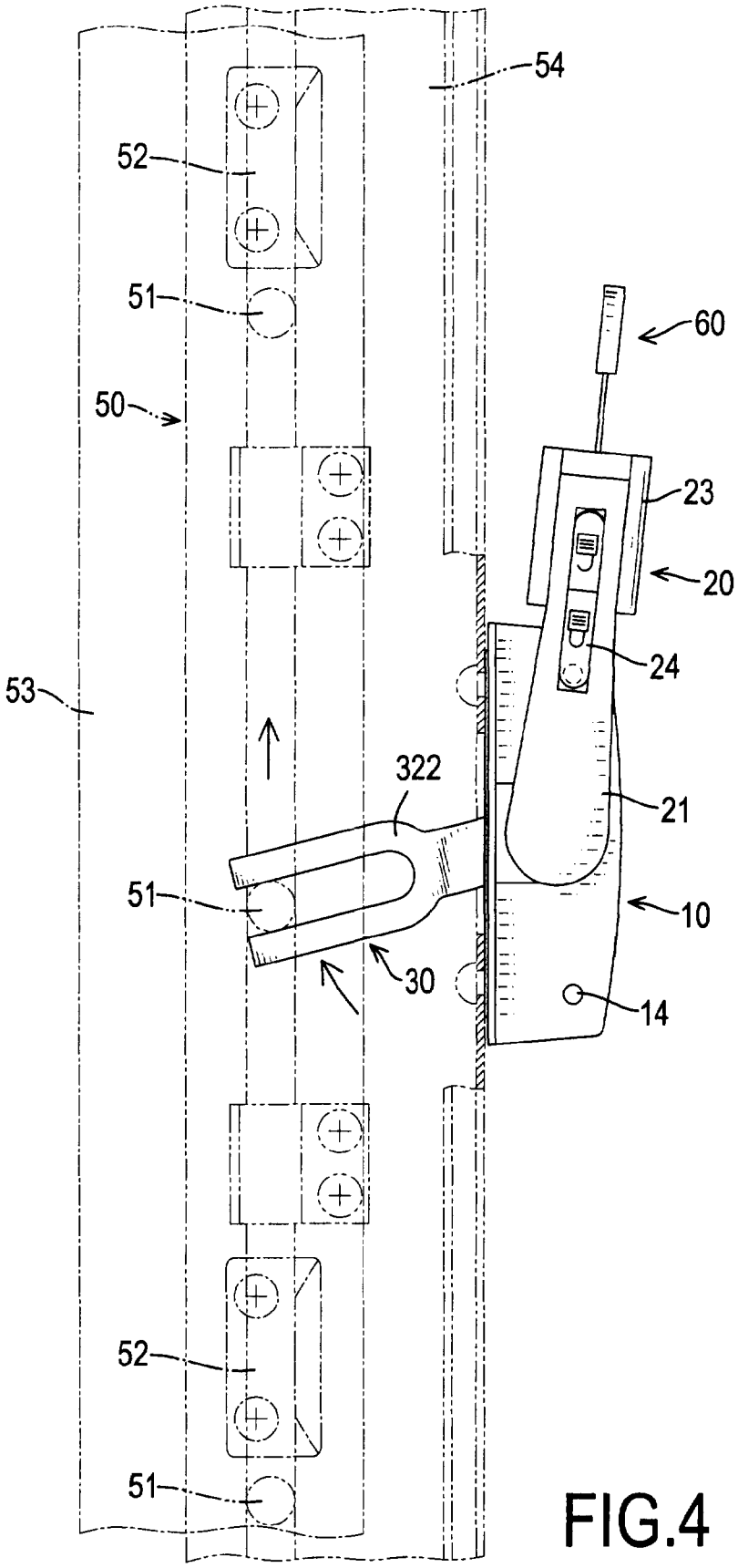
FIG. 4 is an operational side view of the window-locking assembly in FIG. 1 with the window unlocked.
Figure 8:
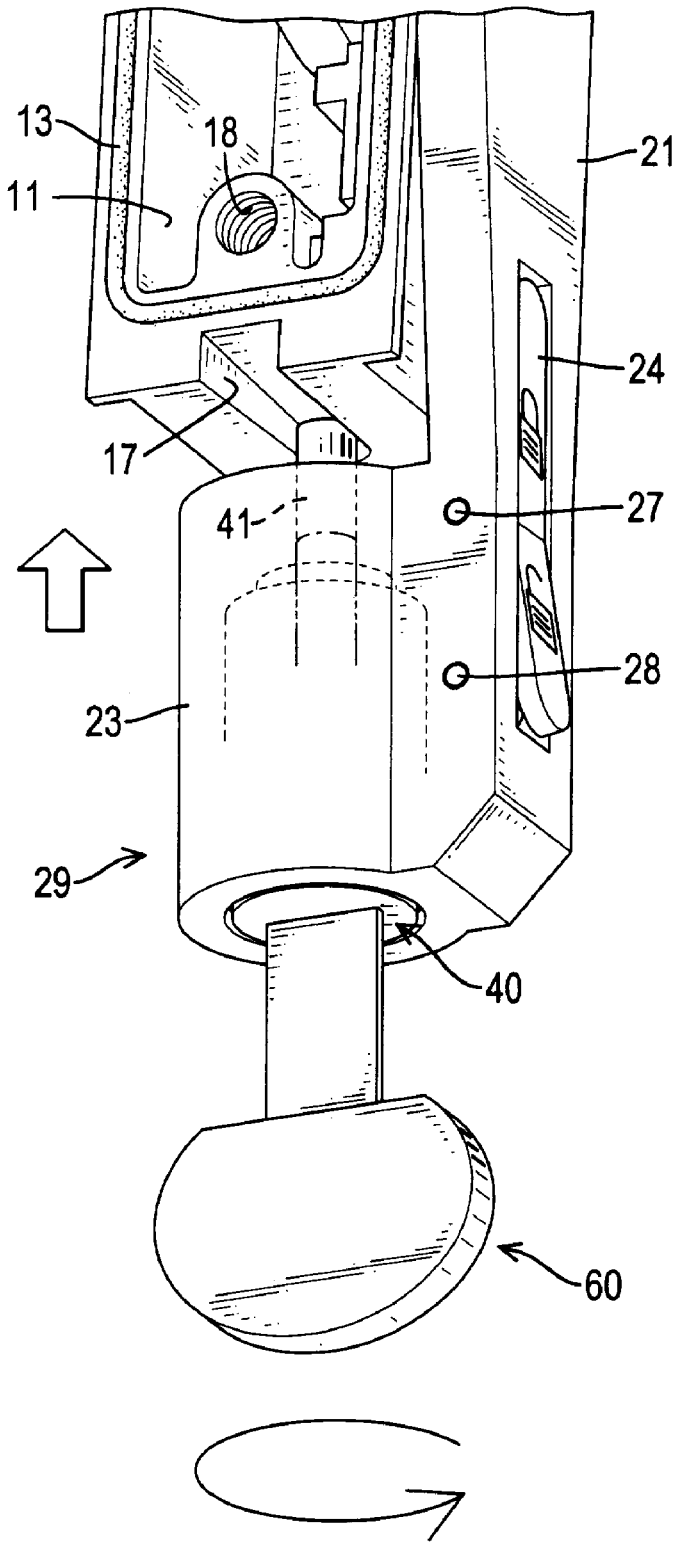
FIG. 8 is an enlarged operational perspective view in partial section of the window-locking assembly in FIG. 1.

The fastening element is connected to the jacket (23) and may be a lock (40). With reference to FIGS. 2 and 8, the lock (40) is mounted securely in the jacket (23) and has an inner end, an outer end, a locking bolt (41), a keyhole and a key (60). The locking bolt (41) is mounted slidably in the lock (40), protrudes coaxially from the inner end of the lock (40), extends through the through hole (231) in the jacket (23) and selectively extends into one of the latch grooves (17) to lock the drive device (20) in place relative to the body (10). The keyhole is formed coaxially in the outer end of the lock (40). The key (60) is inserted into the keyhole and turned to extend or retract the locking bolt (41) respectively into or from the corresponding latch groove (17).

The latch recess (26) is elongated, is formed longitudinally in the outer surface of the handle (21) near the distal end and has two sides, an inner end, an outer end, a latch hole (261), two detent holes (263) and two pivot holes (262). The latch hole (261) is formed through the handle (21) in the latch recess (26) near the inner end and selectively aligns and communicates with one of the detents (14) in the sidewall of the body (10) to lock or unlock the window (53) in the frame (54). The detent holes (263) are formed transversely respectively through the side edges of the handle (21) and the sides of the latch recess (26) near the inner end. The pivot holes (262) are formed respectively through the side edges of the handle (21) and the sides of the latch recess (26) between the latch holes (261) and the detent holes (263).

Figure 9:
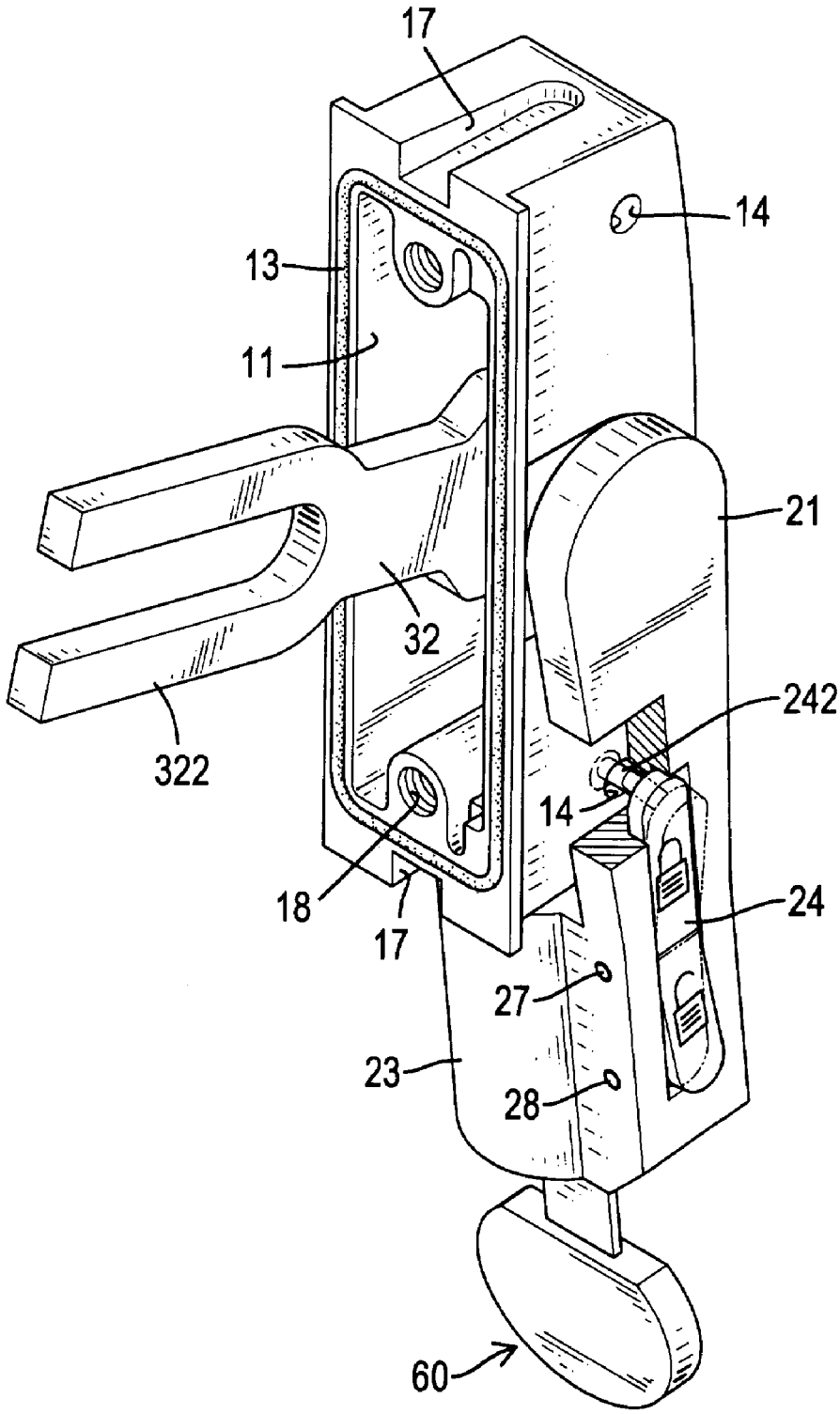
FIG. 9 is an operational perspective view in partial section of the window-locking assembly in FIG. 1.

The rocking latch (24) is a flattened V-shape, is mounted pivotally in the latch recess (26) and has a middle, an inner surface, an inner end, an outer end, a pin hole (241), a latch (242) and a positioning tab (243). The inner surface faces the latch recess (26). The pin hole (241) is formed through the middle of the rocking latch (24) and aligns with the pivot holes (262) of the latch recess (26). With further reference to FIG. 9, the latch (242) is formed on and protrudes from the inner surface of the rocking latch (24) near the inner end, extends through the latch hole (261) and extends into one of the detents (14) in the body (10) to hold the handle (21) in position relative to the body (10) when the latch hole (261) is aligned with the detent (14) to lock or unlock the window (53) in the frame (54). The positioning tab (243) is formed on and protrudes from the inner surface of the rocking latch (24) near the outer end and extends into the latch recess (26) near the detent holes (263) to hold the drive device (20) in position relative to the body (10).

The pivot pin (27) is mounted through the pivot holes (262) of the latch recess (26) and the pin hole (241) in the rocking latch (24) to mount the rocking latch (24) pivotally in the latch recess (26). The holding pin (28) is mounted through the detent holes (263) in the latch recess (26) and presses against the positioning tab (243) to hold the rocking latch (24) in position.

The locking device (30) is connected to and moved by the drive device (20) in the chamber (11) in the body (10) and has a locking arm (32), an optional resilient element (31) and a mounting element (33).

The locking arm (32) is mounted pivotally in the chamber (11) in the body (10), is attached pivotally to the mounting head (22) and has a mounting end (321) and a locking end (322). The mounting end (321) of the locking arm (32) is connected to the mounting head (22) of the drive device (20) in the chamber (11) near the pivot hole (15) in the body (10) and has a center, an outer edge and a mounting hole (3211).

Figure 6:
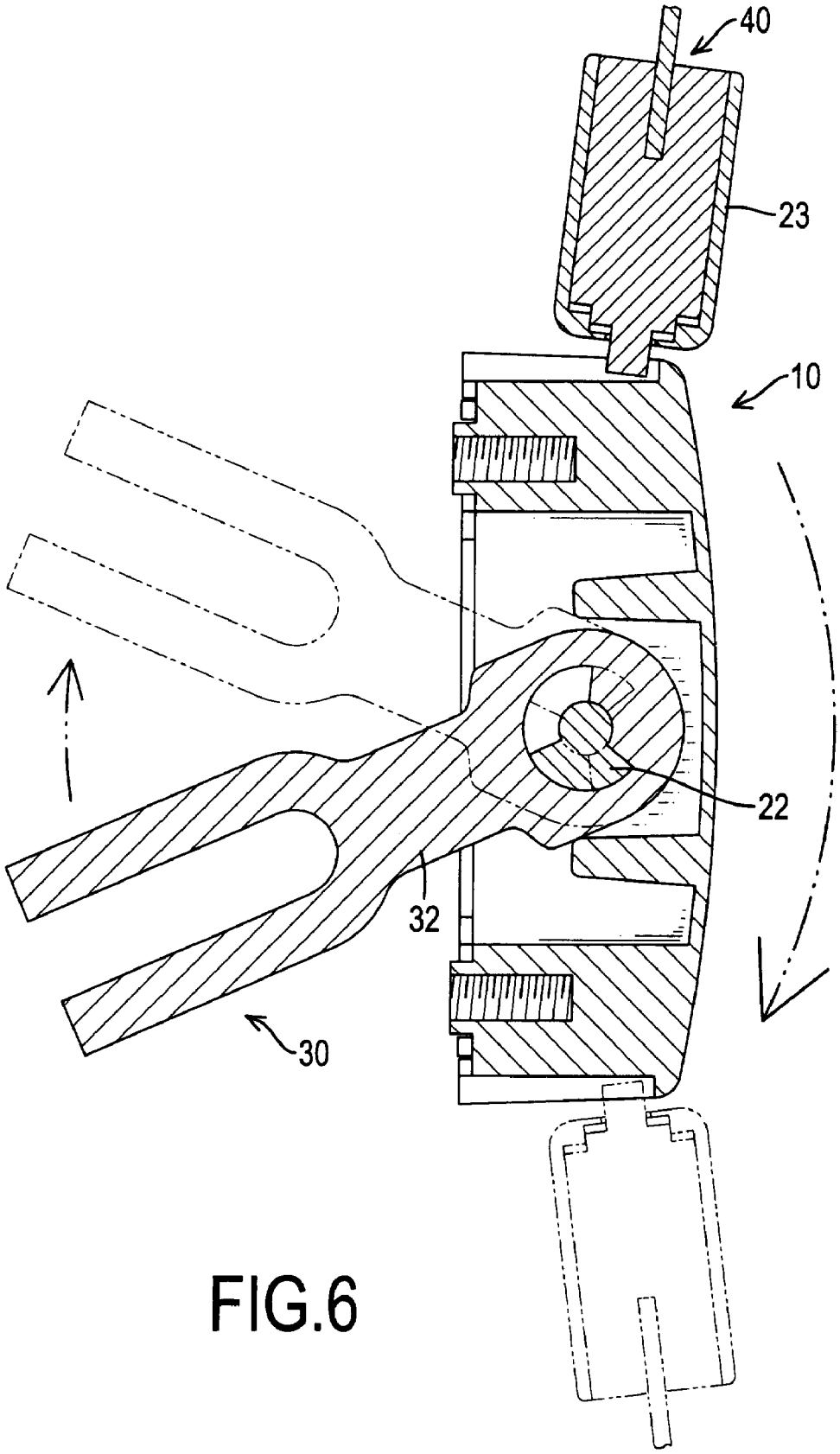
FIG. 6 is an operational side view in partial section of the window-locking assembly in FIG. 1.
Figure 7:
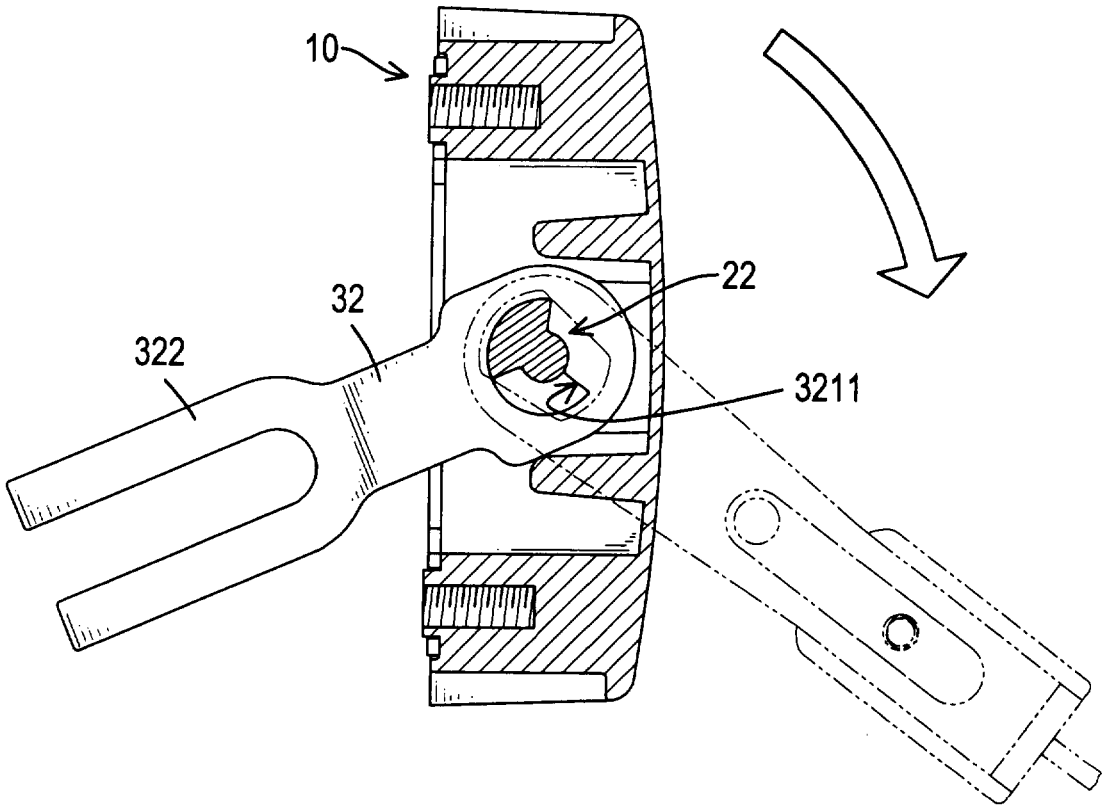
FIG. 7 is an operational side view in partial section of the window-locking assembly in FIG. 1.

The mounting hole (3211) is formed through the center of the mounting end (321), corresponds to and is mounted around the mounting head (22) and has a central hole segment (32111) and a drive segment (32112). The central hole segment (32111) of the mounting hole (3211) symmetries with the central shaft (221). The drive segment (32112) is formed coaxially part way around and communicates with the central hole segment (32111) and inscribes an angle. With reference to FIGS. 6 and 7, the angle is significantly larger than the angle of the outer bearing surface and driver (222) of the mounting head (22) of the drive device (20) so the handle (21) rotates near an angle 180°, then the locking arm (32) will only move enough for the locking posts (51) to engage or disengage from the locking blocks (52) to lock or unlock the window (53) in the frame (54). Therefore, the window-locking assembly can be used on one of the sides in the window assembly (50).

The locking end (322) of the locking arm (32) may be U-shaped and engages one of the locking posts (51) on the locking slide of the frame (54) so the locking slide moves when the locking arm (32) pivots. Moving the locking slide in one direction causes the locking posts (51) to block and press against the short outer side of the locking protrusion on the locking block (52) and locks the window (53) in the frame (54). Moving the locking slide in the other direction moves the locking posts (51) away from the locking protrusion and unlocks the window (53) in the frame (54).

The resilient element (31) is mounted on the shoulders of the spring seat (16) and presses against the outer edge of the mounting end (321) of the locking arm (32) to push the mounting hole (3211) against the mounting head (22).

The mounting element (33) may be C-shaped, is mounted around the distal end of the central shaft (221) of the mounting head (22), maybe mounted in the annular groove in the central shaft (221) of the mounting head (22) and holds the locking arm (32) on the mounting head (22).

Figure 10:
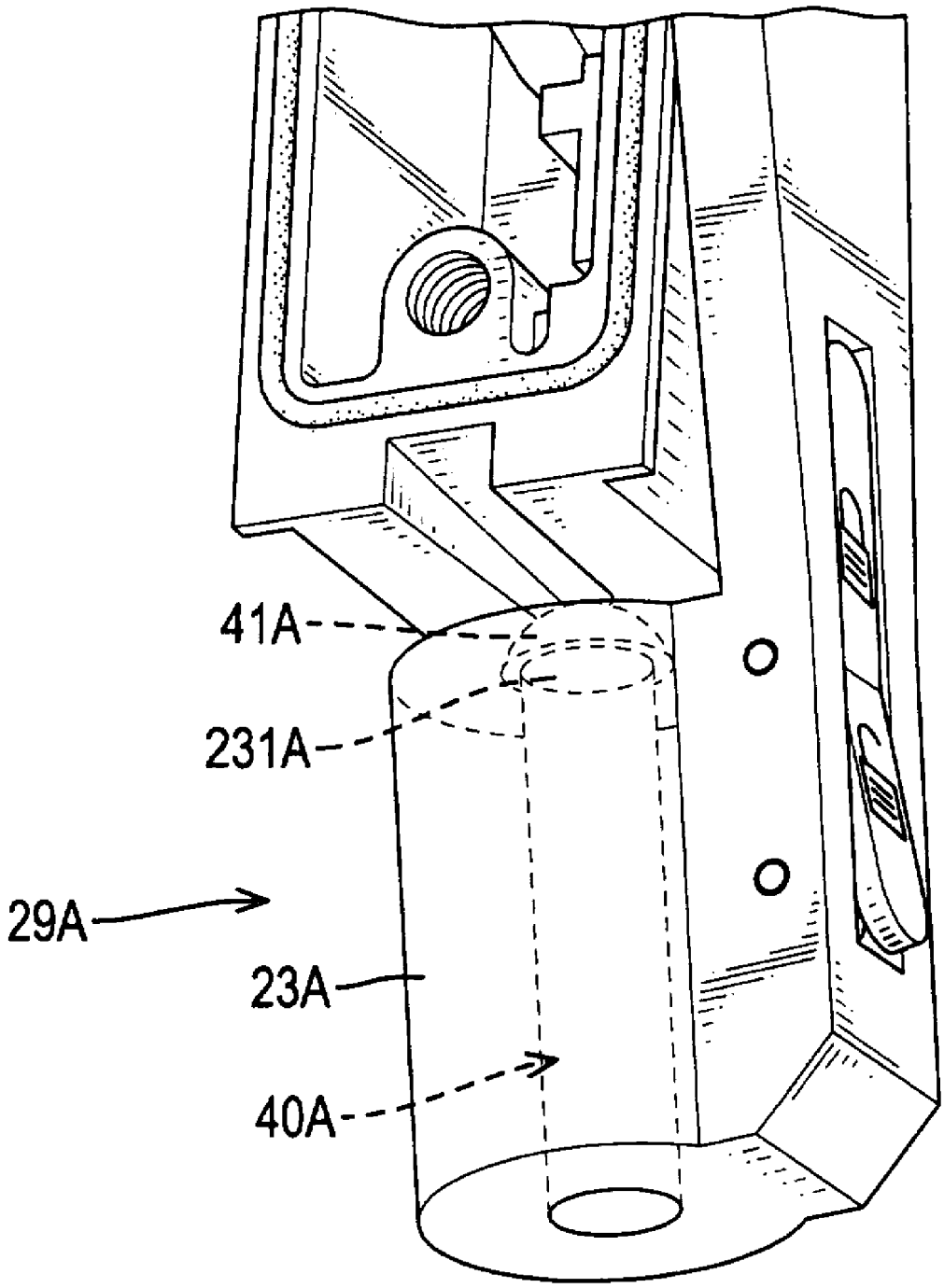
FIG. 10 is an enlarged operational perspective view of a second embodiment of the window-locking assembly in accordance with the present invention.
Figure 11:
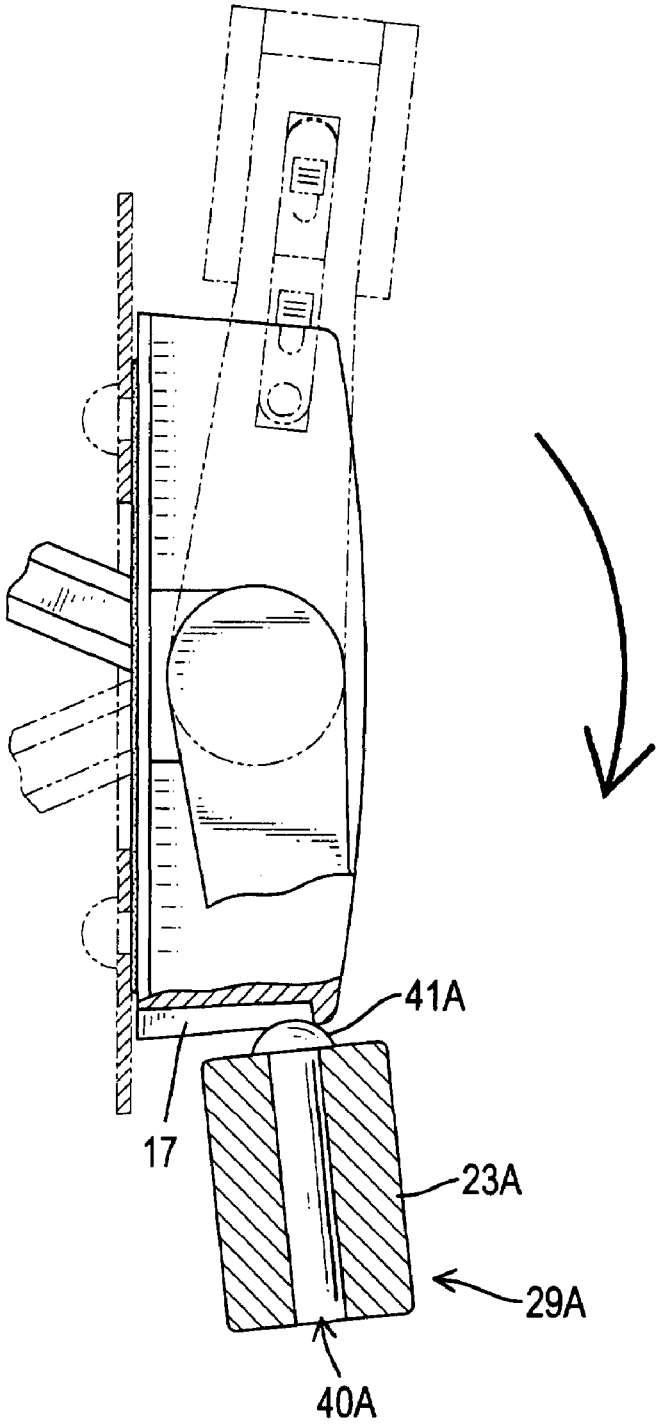
FIG. 11 is another operational side view of the second embodiment of the window-locking assembly that in FIG. 10.

With reference to FIGS. 10 and 11, the second embodiment of the window-locking assembly has a buckling device (29A) formed on and protrudes from the handle (21) near the distal end and has a jacket (23A) and a fastening element.

The jacket (23A) has a closed inner end and a through hole (231A). The closed inner end of the jacket (23A) selectively aligns with the latch grooves (17) in the top and the bottom of the body (10). The through hole (231 A) in the jacket (23A) is formed coaxially through the closed inner end and selectively communicates with the latch grooves (17) at the top or the bottom of the body (10).

The fastening element is connected to the jacket (23A) and may be a locking shaft (40A). The locking shaft (40A) is mounted securely in the jacket (23A) and has an inner end, an outer end and a locking bolt (41A). The locking bolt (41 A) is mounted slidably in the lock (40), protrudes coaxially from the inner end of the locking shaft (40A), extends through the through hole (231 A) in the jacket (23A) and selectively extends into one of the latch grooves (17) to lock the drive device (20) in place relative to the body (10).

Figure 12:
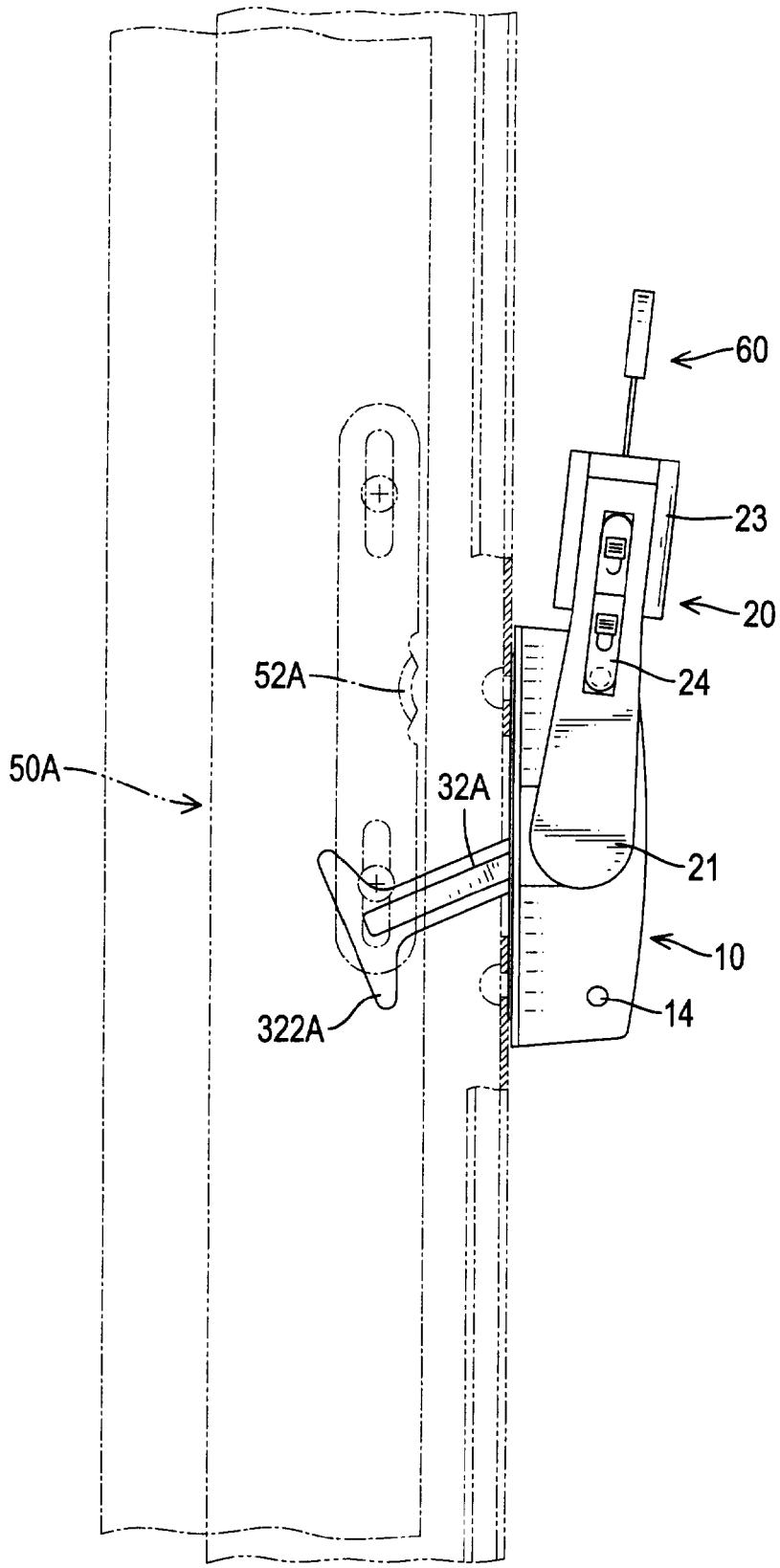
FIG. 12 is an operational side view of a third embodiment of the window-locking assembly in accordance with the present invention with the window unlocked.
Figure 13:
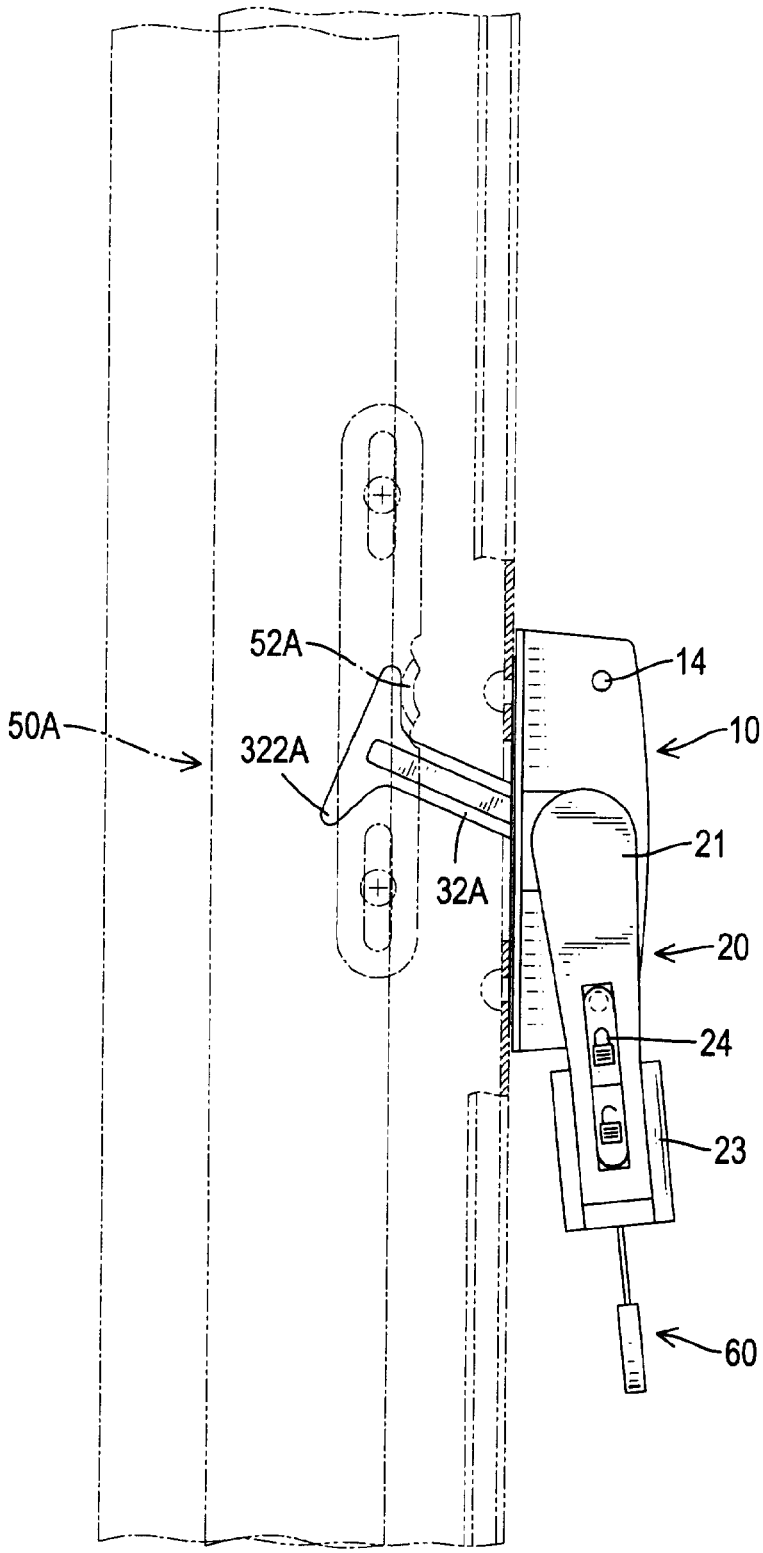
FIG. 13 is another operational side view of the third embodiment of the window-locking assembly that in FIG. 12 with the window locked in the frame.

With reference to FIGS. 12 and 13, the third embodiment of the window-locking assembly has a locking arm (32A) mounted pivotally in the chamber (11) in the body (10), is attached pivotally to the mounting head (22) and has a locking end (322A).

The locking end (322A) of the locking arm (32A) maybe T-shaped and engages one of the locking blocks (52A) of the window assembly (50A).

Figure 14:
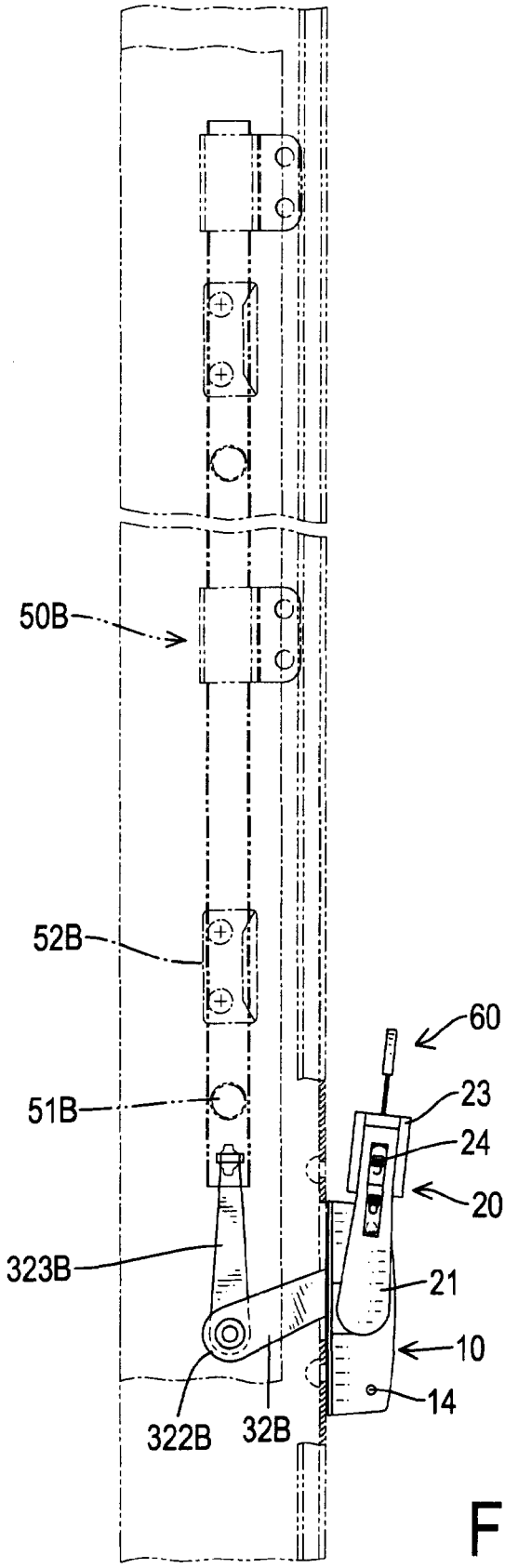
FIG. 14 is an operational side view of a fourth embodiment of the window-locking assembly in accordance with the present invention with the window unlocked.
Figure 15:
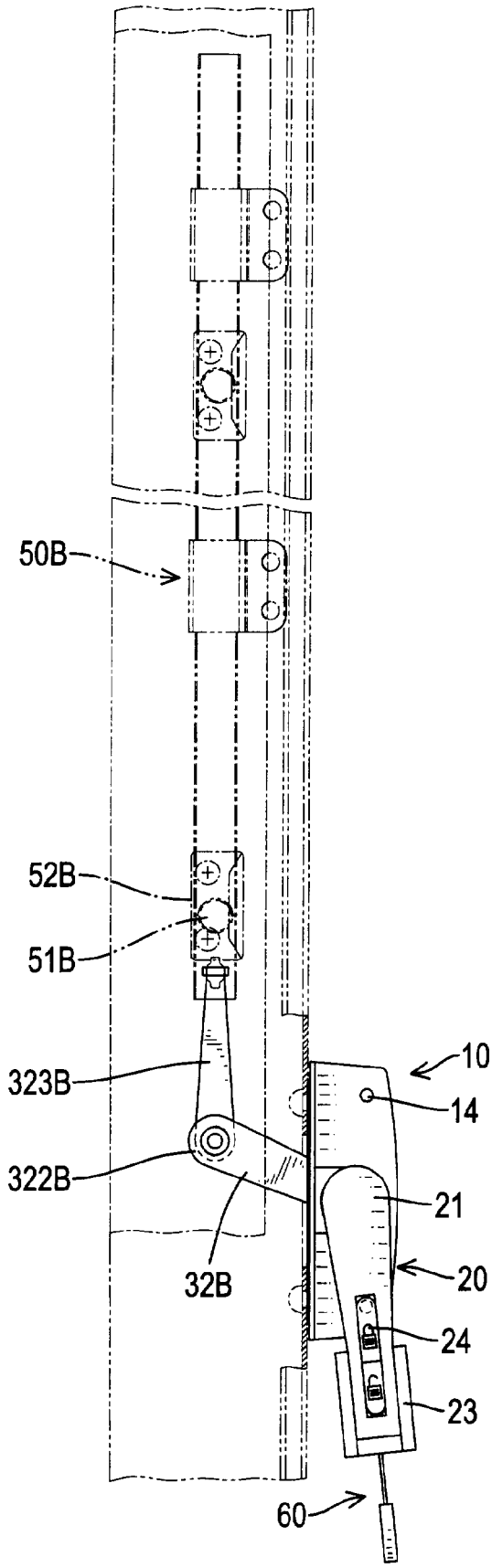
FIG. 15 is another operational side view of the fourth embodiment of the window-locking assembly that in FIG. 14 with the window locked in the frame.

With reference to FIGS. 14 and 15, the fourth embodiment of the window-locking assembly has a locking arm (32B) mounted pivotally in the chamber (11) in the body (10), is attached pivotally to the mounting head (22) and has a locking end (322B) and a moving arm (323B).

The moving arm (323B) is connected to the locking end (322B) and the window assembly (50B), pushes one of the locking posts (51B) engaging with a corresponding locking block (52B).

The window-locking assembly has the following advantages.

1. The angle of the drive segment (32112) is significantly larger than the angle of the outer bearing surface and driver (222) of the mounting head (22) of the drive device (20) so the handle (21) rotates near an angle 180°, then the locking arm (32) will only move enough for the locking posts (51) to engage or disengage from the locking blocks (52) to lock or unlock the window (53) in the frame (54). Therefore, the window-locking assembly can be used on one of the sides in the window assembly (50).

2. The window-locking assembly locks the window (53) securely in the frame (54) by rotating the drive device (20) relative to the body (10), which moves the locking slide and the locking posts (51) that block the locking blocks (52) on the window (53). Therefore, locking the window assembly (50) is quick and convenient.

3. Attaching the window-locking assembly to a window assembly (50) is easy, and the window-locking assembly is convenient to manufacture and can be used on one of the sides in the window assembly (50) at individual time.

4. The rocking latch (24) of the drive device (20) and the lock (40) of the window-locking assembly can keep children from opening the window (53) easily and keeps people without authorization from having access through the window (53). Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A window-locking assembly used on a window assembly and comprising:

a body having a chamber being defined in the body between an open front and a closed rear; and a pivot hole being formed through a sidewall and communicating with the chamber;

a handle being mounted pivotally in the body and having a proximal end; and an inner surface; and a mounting head being formed on protruding from the inner surface of the handle near the proximal end, being mounted rotatably in the pivot hole, extending into the chamber in the body and having a central shaft with a proximal end being attached to the inner surface of the handle; and an outer bearing surface and driver being formed part way around the central shaft at the proximal end, protruding radially out from the central shaft and inscribing an angle; and a locking device being connected to and moved by the handle in the chamber in the body and having a locking arm being mounted pivotally in the chamber in the body, being attached pivotally to the mounting head and having a mounting end being connected to the mounting head in the chamber near the pivot hole in the body with a mounting hole being formed through a center of the mounting end, corresponding to and being mounted around the mounting head and having a central hole segment; and a drive segment being formed coaxially part way around and communicating with the central hole segment and inscribing an angle significantly larger than the angle of the outer bearing surface and driver of the mounting head; and a locking end; and a mounting element mounted around a distal end of the central shaft of the mounting head and holding the locking arm on the mounting head, wherein the handle further has
an outer surface; and
two side edges; and
a latch recess being elongated, formed longitudinally in the outer surface of the handle near the distal end and having
two sides;
an inner end;
an outer end;
a latch hole formed through the handle in the latch recess near the inner end and selectively aligning with one of the detents in the sidewall of the body;
two detent holes formed transversely respectively through the side edges of the handle and the sides of the latch recess near the inner end; and
two pivot holes formed respectively through the side edges of the handle and the sides of the latch recess between the latch holes and the detent holes; and
a rocking latch being a flattened V-shape, mounted pivotally in the latch recess.

2. The window-locking assembly as claimed in claim 1, wherein
the body further has
a top;
a bottom;
two detents being formed through the sidewall of the body respectively near the top and bottom of the body and communicate with the chamber; and
two latch grooves being formed respectively in the top and the bottom of the body;
the handle further has
a distal end;
a buckling device being formed on protruding from the inner surface of the handle near the distal end and having
a jacket being a hollow cylinder, being mounted longitudinally on the inner surface of the handle near the distal end and having
a closed inner end selectively aligning with the latch grooves in the top and the bottom of the body;
an open outer end; and
a through hole being formed coaxially through the closed inner end and selectively communicates with the latch grooves at the top or the bottom of the body and the open outer end of the jacket; and
a fastening element being mounted securely in the jacket, being a lock and has
an inner end;
an outer end;
a locking bolt mounted slidably in the lock, protruding coaxially from the inner end of the lock, extending through the through hole in the jacket and selectively extending into one of the latch grooves to lock the handle in place relative to the body; and
a keyhole formed coaxially in the outer end of the lock.

3. The window-locking assembly as claimed in claim 1, wherein
the body further has
a top;
a bottom;
two detents being formed through the sidewall of the body respectively near the top and bottom of the body and communicate with the chamber; and
two latch grooves being formed respectively in the top and the bottom of the body;
the handle further has
a distal end;
a buckling device being formed on protruding from the inner surface of the handle near the distal end and having
a jacket being a hollow cylinder, being mounted longitudinally on the inner surface of the handle near the distal end and having
a closed inner end selectively aligning with the latch grooves in the top and the bottom of the body; and
a through hole being formed coaxially through the closed inner end and selectively communicates with the latch grooves at the top or the bottom of the body and the open outer end of the jacket; and
a fastening element being mounted securely in the jacket, being a locking shaft and has
an inner end;
an outer end; and
a locking bolt mounted slidably in the lock, protruding coaxially from the inner end of the locking shaft, extending through the through hole in the jacket and selectively extending into one of the latch grooves to lock the handle in place relative to the body.

4. The window-locking assembly as claimed in claim 1, wherein
the body further has
a seal groove formed in the open front of the body around the chamber; and
a waterproof seal mounted in the seal groove to prevent water from flowing into the chamber through the open front; and
a spring seat being formed in the chamber adjacent to the sidewall with the pivot hole, communicating with the pivot hole and having
an upper shoulder;
a lower shoulder; and
a central recess; and
a locking device further has
a resilient element being mounted on the shoulders of the spring seat and pressing against an outer edge of the mounting end of the locking arm to push the mounting hole against the mounting head.

5. The window-locking assembly as claimed in claim 1, wherein
the body further has
two mounting holes formed in the open front of the body respectively near the top and the bottom; and
two fasteners are secured in the mounting holes; and
the handle further has a washer mounted around the mounting head and engaging the pivot hole in the body.

6. The window-locking assembly as claimed in claim 1, wherein
the rocking latch further has
a middle;
an inner surface facing the latch recess;
an inner end;
an outer end;
a pin hole formed through the middle of the rocking latch and communicating with the pivot holes of the latch recess;
a latch formed on and protruding from the inner surface of the rocking latch near the inner end, extending through the latch hole and extending into one of the detents in the body to hold the handle in position relative to the body; and a positioning tab formed on and protruding from the inner surface of the rocking latch near the outer end and extending into the latch recess near the detent holes; and the handle further has a pivot pin mounted through the pivot holes of the latch recess and the pin hole in the rocking latch to mount the rocking latch pivotally in the latch recess; and a holding pin mounted through the detent holes of the latch recess and pressing against the positioning tab to hold the rocking latch in position.

7. The window-locking assembly as claimed in claim 1, wherein the central shaft of the mounting head further has an annular groove formed around the central shaft near the distal end; and the mounting element is C-shaped and is mounted in the annular groove in the central shaft.

8. The window-locking assembly as claimed in claim 1, wherein the locking end of the locking arm is T-shaped;

the central shaft of the mounting head further has an annular groove formed around the central shaft near the distal end; and the mounting element is C-shaped and is mounted in the annular groove in the central shaft.

9. The window-locking assembly as claimed in claim 1, wherein the locking arm further has a moving arm connected to the locking end and the window assembly.

10. The window-locking assembly as claimed in claim 2, wherein the body further has a seal groove formed in the open front of the body around the chamber; and a waterproof seal mounted in the seal groove to prevent water from flowing into the chamber through the open front; and a spring seat being formed in the chamber adjacent to the sidewall with the pivot hole, communicating with the pivot hole and having an upper shoulder;

a lower shoulder; and a central recess; and a locking device further has a resilient element being mounted on the shoulders of the spring seat and pressing against the outer edge of the mounting end of the locking arm to push the mounting hole against the mounting head.

11. The window-locking assembly as claimed in claim 3, wherein the body further has a seal groove formed in the open front of the body around the chamber; and a waterproof seal mounted in the seal groove to prevent water from flowing into the chamber through the open front; and a spring seat being formed in the chamber adjacent to the sidewall with the pivot hole, communicating with the pivot hole and having an upper shoulder;

a lower shoulder; and a central recess; and a locking device further has a resilient element being mounted on the shoulders of the spring seat and pressing against the outer edge of the mounting end of the locking arm to push the mounting hole against the mounting head.

12. The window-locking assembly as claimed in claim 11, wherein the rocking latch further has a middle;

an inner surface facing the latch recess;

an inner end;

an outer end;

a pin hole formed through the middle of the rocking latch and communicating with the pivot holes of the latch recess;

a latch formed on and protruding from the inner surface of the rocking latch near the inner end, extending through the latch hole and extending into one of the detents in the body to hold the handle in position relative to the body; and a positioning tab formed on and protruding from the inner surface of the rocking latch near the outer end and extending into the latch recess near the detent holes; and the handle further has a pivot pin mounted through the pivot holes of the latch recess and the pin hole in the rocking latch to mount the rocking latch pivotally in the latch recess; and a holding pin mounted through the detent holes of the latch recess and pressing against the positioning tab to hold the rocking latch in position.

13. The window-locking assembly as claimed in claim 12, wherein the central shaft of the mounting head further has an annular groove formed around the central shaft near the distal end; and the mounting element is C-shaped and is mounted in the annular groove in the central shaft.

14. The window-locking assembly as claimed in claim 12, wherein the locking end of the locking arm is T-shaped;

the central shaft of the mounting head further has an annular groove formed around the central shaft near the distal end; and the mounting element is C-shaped and is mounted in the annular groove in the central shaft.

* * * * *